US011767618B2

(12) United States Patent
Bhatnagar

(10) Patent No.: US 11,767,618 B2
(45) Date of Patent: Sep. 26, 2023

(54) RING SPUN YARN AND METHOD

(71) Applicant: Target Brands, Inc., Minneapolis, MN (US)

(72) Inventor: Avinash Bhatnagar, Apple Valley, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 17/838,625

(22) Filed: Jun. 13, 2022

(65) Prior Publication Data

US 2022/0325441 A1 Oct. 13, 2022

Related U.S. Application Data

(62) Division of application No. 16/668,460, filed on Oct. 30, 2019, now Pat. No. 11,359,309.

(60) Provisional application No. 62/783,835, filed on Dec. 21, 2018.

(51) Int. Cl.

| | |
|---|---|
| ***D02G 3/04*** | (2006.01) |
| ***D01H 7/52*** | (2006.01) |
| ***D01H 1/02*** | (2006.01) |

(52) U.S. Cl.

CPC ..... *D02G 3/04* (2013.01); *D01H 1/02* (2013.01); *D01H 7/52* (2013.01); *D10B 2201/02* (2013.01); *D10B 2331/04* (2013.01)

(58) Field of Classification Search

CPC .. D01H 1/02; D01H 5/22; D01H 7/52; D02G 3/04

See application file for complete search history.

(56) References Cited

U.S. PATENT DOCUMENTS

| | | | | |
|---|---|---|---|---|
| 2,072,642 | A | 3/1937 | Martin | |
| 3,051,997 | A | 9/1962 | Renevialle | |
| 3,987,615 | A | 10/1976 | Hill | |
| 4,019,225 | A | 4/1977 | Nayfa | |
| 4,991,387 | A | 2/1991 | Tashiro | |
| 5,007,136 | A | 4/1991 | Artzt | |
| 5,155,989 | A | 10/1992 | Frey | |
| 5,534,336 | A | 7/1996 | Nomura et al. | |
| 5,970,700 | A | 10/1999 | Schreer | |
| 6,250,060 | B1 | 6/2001 | Schreer | |
| 6,470,534 | B2 | 10/2002 | Kim | |
| 11,359,309 | B2 * | 6/2022 | Bhatnagar | D01H 1/02 |

(Continued)

FOREIGN PATENT DOCUMENTS

| | | | |
|---|---|---|---|
| CN | 1185495 | A | 6/1998 |
| CN | 1093573 | C | 10/2002 |

(Continued)

OTHER PUBLICATIONS

Kathryn L. Hatch, Textile Science, West Publishing Company, pp. 272-273, (1993).

(Continued)

*Primary Examiner* — Shaun R Hurley

(74) *Attorney, Agent, or Firm* — Merchant & Gould P.C.

(57) ABSTRACT

A method of ring spinning cotton polyester blended yarn. The method is robust and can be used to manufacture the yarn even from polyester fibers that are produced from recycled materials. A new ring spun cotton polyester yarn is also provided. The yarn has few defects and can be effectively dyed when woven into cloth.

7 Claims, 3 Drawing Sheets

(56) References Cited

U.S. PATENT DOCUMENTS

| | | | |
|---|---|---|---|
| 2003/0159423 | A1 | 8/2003 | Hietpas |
| 2006/0150610 | A1 | 7/2006 | Negola |
| 2006/0185343 | A1 | 8/2006 | Coombs |
| 2009/0173055 | A1 | 7/2009 | Silver |
| 2017/0175323 | A1 | 6/2017 | Yu et al. |
| 2018/0305847 | A1 | 10/2018 | Wen et al. |
| 2019/0301059 | A1 | 10/2019 | Flack |

FOREIGN PATENT DOCUMENTS

| | | | |
|---|---|---|---|
| CN | 101067254 | A | 11/2007 |
| CN | 101126188 | B | 5/2010 |
| CN | 101831732 | B | 10/2011 |
| CN | 102277732 | B | 2/2013 |
| CN | 202786605 | U | 3/2013 |
| CN | 102181988 | B | 6/2013 |
| CN | 103184623 | A | 7/2013 |
| CN | 103266375 | A | 8/2013 |
| CN | 103266383 | A | 8/2013 |
| CN | 103757763 | A | 4/2014 |
| CN | 104120525 | A | 10/2014 |
| CN | 103829385 | B | 1/2015 |
| CN | 104389052 | A | 3/2015 |
| CN | 104611804 | A | 5/2015 |
| CN | 104611805 | A | 5/2015 |
| CN | 104611806 | A | 5/2015 |
| CN | 104630958 | A | 5/2015 |
| CN | 104630959 | A | 5/2015 |
| CN | 104651997 | A | 5/2015 |
| CN | 103040170 | B | 6/2015 |
| CN | 104674453 | A | 6/2015 |
| CN | 106555260 | A | 4/2017 |
| CN | 107345319 | A | 11/2017 |
| CN | 107400945 | A | 11/2017 |
| CN | 107557940 | A | 1/2018 |
| CN | 107687042 | A | 2/2018 |
| CN | 107700008 | A | 2/2018 |
| CN | 108193503 | A | 6/2018 |
| CN | 108265363 | A | 7/2018 |
| CN | 108396430 | A | 8/2018 |
| CN | 108893833 | A | 11/2018 |
| CN | 109930270 | A | 6/2019 |
| CN | 109943931 | A | 6/2019 |
| CN | 110284234 | A | 9/2019 |
| CN | 110331485 | A | 10/2019 |
| CN | 110714246 | A | 1/2020 |
| CN | 110747553 | A | 2/2020 |
| CN | 111455501 | A | 7/2020 |
| CN | 211005786 | U | 7/2020 |
| CN | 111549436 | A | 8/2020 |
| CN | 111691034 | A | 9/2020 |
| CN | 211471705 | U | 9/2020 |
| CN | 111748887 | A | 10/2020 |
| CN | 111764030 | A | 10/2020 |
| CN | 112011868 | A | 12/2020 |
| CN | 212505237 | U | 2/2021 |
| CN | 113174678 | A | 7/2021 |
| CN | 113512790 | A | 10/2021 |
| CN | 113972444 | A | 1/2022 |
| DE | 44 33 710 | A1 | 3/1995 |
| EP | 0 981 658 | B1 | 12/2001 |
| EP | 1 336 674 | A1 | 8/2003 |
| EP | 1 591 572 | A1 | 11/2005 |
| EP | 1 327 013 | B1 | 1/2007 |
| EP | 1 945 839 | B1 | 12/2011 |
| EP | 2 434 035 | A1 | 3/2012 |
| EP | 2 463 418 | A1 | 6/2012 |
| EP | 2 503 036 | A1 | 9/2012 |
| EP | 1 738 003 | B1 | 12/2012 |
| EP | 2 642 007 | A1 | 9/2013 |
| EP | 2 730 695 | A1 | 5/2014 |
| EP | 2 735 644 | A1 | 5/2014 |
| EP | 2 762 618 | A1 | 8/2014 |
| EP | 3 037 574 | A1 | 6/2016 |
| EP | 3 192 908 | A1 | 7/2017 |
| EP | 3 243 940 | A1 | 11/2017 |
| EP | 3 385 418 | A1 | 10/2018 |
| EP | 3 434 817 | A1 | 1/2019 |
| EP | 2 791 404 | B1 | 9/2019 |
| EP | 3 536 836 | A1 | 9/2019 |
| EP | 3 663 444 | A1 | 6/2020 |
| EP | 3 725 923 | A1 | 10/2020 |
| EP | 3 951 035 | A1 | 2/2022 |
| JP | 2004-52176 | A | 2/2004 |
| JP | 2016-216857 | A | 12/2016 |
| JP | 2016-216858 | A | 12/2016 |
| JP | 2019-11542 | A | 1/2019 |
| JP | 2020-176345 | A | 10/2020 |
| JP | 2021-17675 | A | 2/2021 |
| WO | WO 97/01661 | A1 | 1/1997 |
| WO | WO 98/46814 | A1 | 10/1998 |
| WO | WO 2004/015182 | A1 | 2/2004 |
| WO | WO 2005/075722 | A1 | 8/2005 |
| WO | WO 2006/043342 | A1 | 4/2006 |
| WO | WO 2010/071910 | A2 | 7/2010 |
| WO | WO 2014/106858 | A2 | 7/2014 |
| WO | WO 2017/135499 | A1 | 8/2017 |
| WO | WO 2018/127991 | A1 | 7/2018 |
| WO | WO 2018/153844 | A1 | 8/2018 |
| WO | WO 2018/232344 | A2 | 12/2018 |
| WO | WO 2019/058449 | A1 | 3/2019 |
| WO | WO 2019/076967 | A2 | 4/2019 |
| WO | WO 2019/146787 | A1 | 8/2019 |
| WO | WO 2019/168845 | A1 | 9/2019 |
| WO | WO 2010/006043 | A1 | 1/2020 |
| WO | WO 2020/170469 | A1 | 8/2020 |

OTHER PUBLICATIONS

Carl A. Lawrence, Fundamentals of Spun Yarn Technology (2003), CRC Press, pp. 230-233.

* cited by examiner

RING SPUN YARN AND METHOD

CROSS-REFERENCE TO RELATED APPLICATIONS

This application is a divisional of U.S. application Ser. No. 16/668,460, filed Oct. 30, 2019, which claims the benefit of U.S. Provisional Application Ser. No. 62/783,835 filed on Dec. 21, 2018, the entire disclosures of which are hereby expressly incorporated herein by reference.

TECHNICAL FIELD

The present disclosure provides a new method of ring spinning yarn as well as new yarn and fabric.

BACKGROUND

In order to create garments with desirable functional properties, it is often desirable to construct them from fabrics that include a blend of materials. Cotton and polyester blends are known to result in a fabric with desirable qualities. Fabrics that are constructed of blends are often woven or knit from yarn that is manufactured from a blend of fibers.

Blending different fibers to create yarn can be challenging. It is desirable to create blends that are consistent, strong, and amendable to dyeing. The challenges can be increased when the fibers themselves are less consistent. It is particularly difficult to produce high quality yarn from recycled polyester as the fibers themselves are less consistent than virgin polyester fibers. Recycled polyester fibers are manufactured from a number of different sources including such things as used soda and water bottles, which can result in inconsistencies that can translate into defects in the resulting yarn and fabric made therefrom. When conventional methods of manufacturing yarn are applied to manufacture a cotton recycled polyester blend, an undesirable amount of undyed specs are often found in the resulting fabric. There is a need in the art for improved methods of manufacturing yarn that enable manufacturing yarn from recycled fibers. There is also a need for improved blended yarn, improved fabric, and improved garments.

SUMMARY

The present disclosure provides a method of manufacturing cotton polyester blended yarn. The method is robust and can be used to manufacture the yarn even from polyester fibers that are produced from recycled materials. The resulting yarn and fabric is sufficiently defect free and can be consistently dyed. A new cotton polyester cotton blended yarn is also provided.

DETAILED DESCRIPTION

Figure 1A:
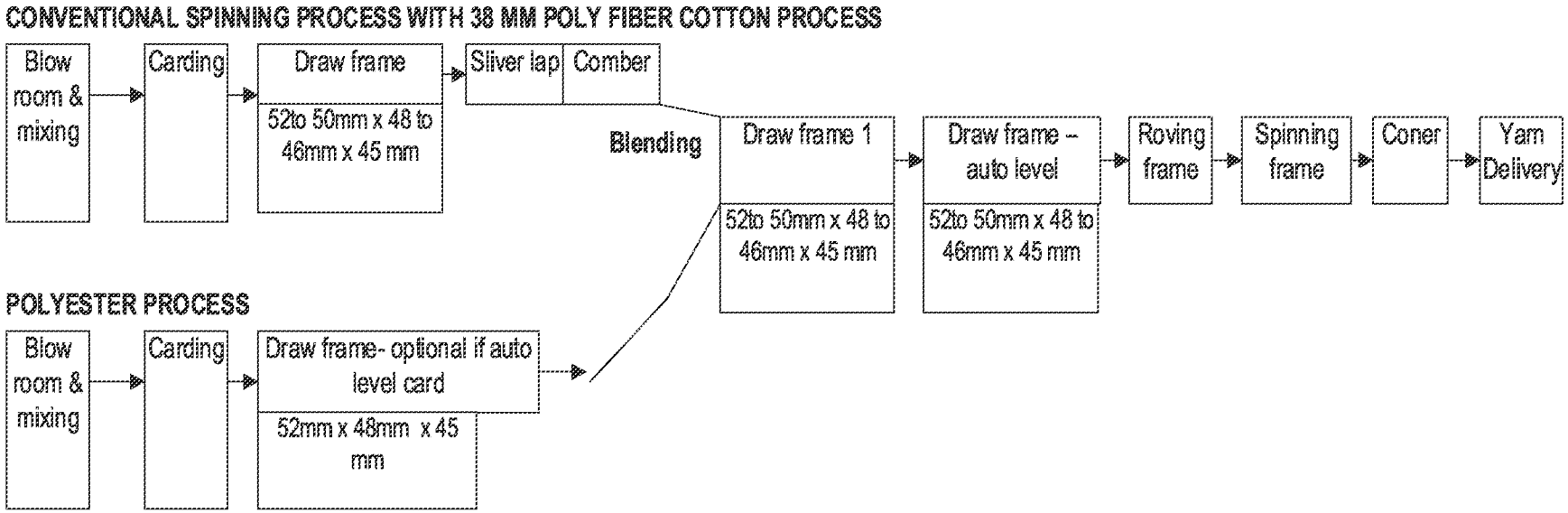
FIG. 1A (Prior Art)
FIG. 1A is a schematic illustration of a known yarn manufacturing process.
Figure 1B:
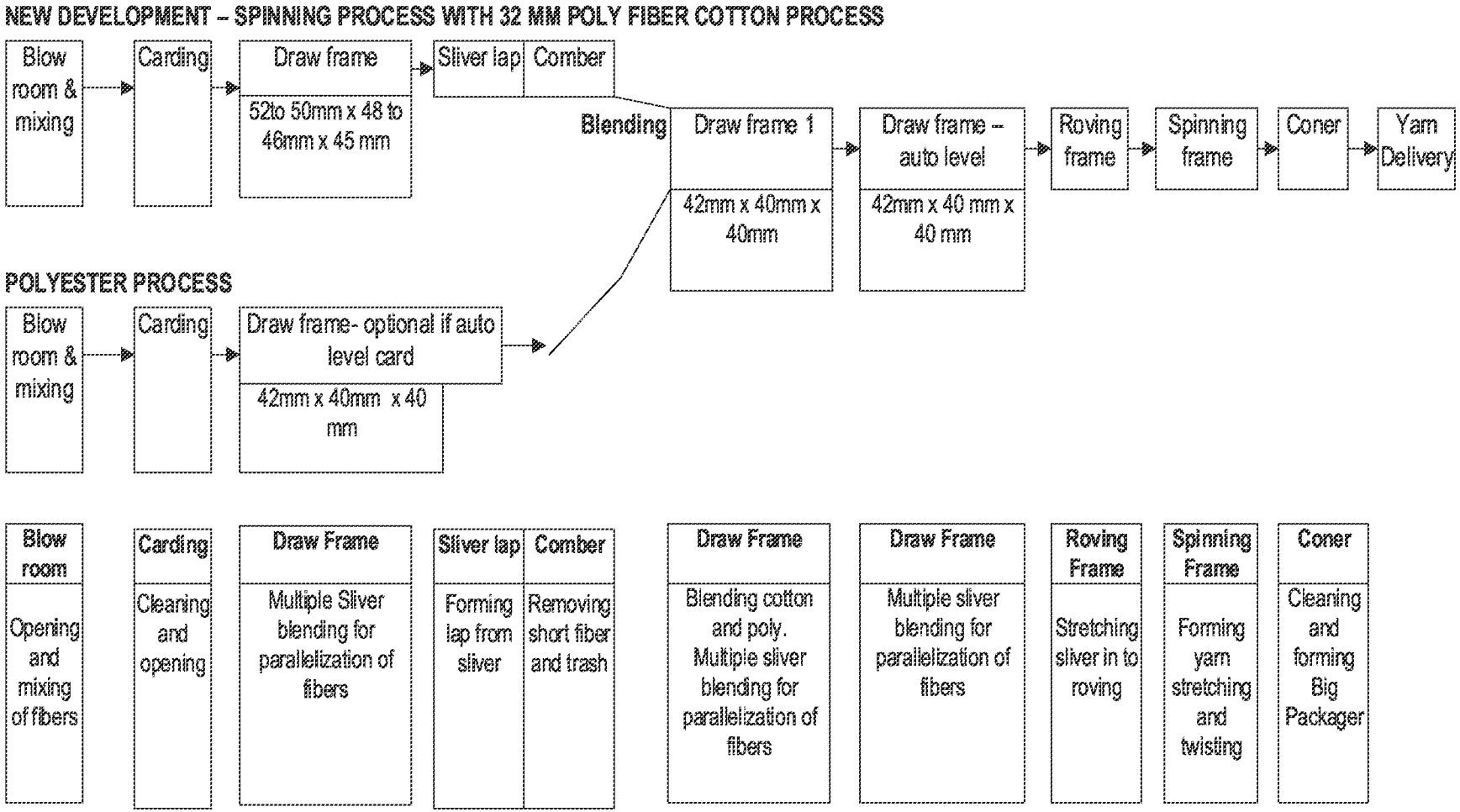
FIG. 1B is a schematic illustration of a yarn manufacturing process according to the principles of the present disclosure.
Figure 2:
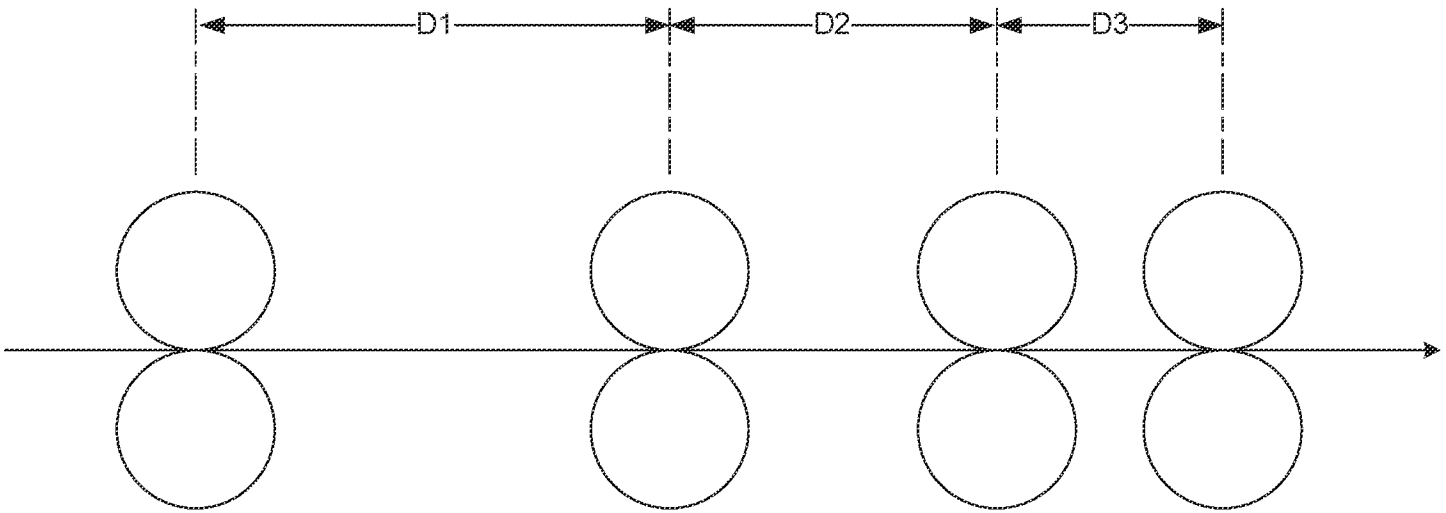
FIG. 2 is a schematic illustration of a portion of the manufacturing process shown in FIG.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

The present disclosure provides a method of manufacturing a cotton and recycled polyester blended yarn. The present disclosure also relates to a new cotton and recycled polyester blended yarn. The new yarn has less defects and can be more consistently dyed as compared to known cotton and recycled polyester blended yarns.

The yarn of the present disclosure has relatively few defects as compared to cotton recycled polyester yarn of the prior art. An automated defect identification and classification devices such as the "Uster Classimat 5" can be used to inspect yarn and quantify defects. The chart below illustrates the relative difference between the yarn of the present disclosure and prior art yarn manufacture of the same blended materials. Yarn manufactured according to the prior art and according to the method of the present disclosure were compared at three different manufacturing facilities.

In all the trials, the manufacturing method of the present disclosure resulted in improved yarn as compared to yarn manufactured at the same facility pursuant to the known manufacturing method. The yarn of the present disclosure had less defects.

| | Prior Art Yarn | | | New Yarn | | |
|---|---|---|---|---|---|---|
| | Sritex Indonesia | Tah Tong Vietnam | Tainan Vietnam | Sritex Indonesia | Tah Tong Vietnam | Tainan Vietnam |
| Material | 1.4 D × 38 recycled polyester in a 60/40 blend with cotton | | | 1.2 D × 32 recycled polyester in a 60/40 blend with cotton | | |
| Imperfections/ 1000 m | | | | | | |
| Thin (−50%) | 1 | 1 | 2 | 0 | 0 | 1 |
| Thick (+50%) | 32 | 65.99 | 45 | 22 | 54.99 | 33 |
| Neps (200%) | 57 | 148.97 | 139 | 52 | 132.98 | 122 |
| Total | 90 | 215.96 | 186 | 74 | 187.97 | 156 |
| Hairiness | 5.57 | | 65.9 | 5.27 | | 67.9 |
| Single Yarn Strength | 332.7 | 391.2 | 304.1 | 380 | 344.2 | 296.2 |
| CV % | 6.66 | | | 6.03 | | |
| Elongation (%) | 7.15 | 8 | 5.3 | 5.87 | 7.6 | 4.9 |

-continued

| | Prior Art Yarn | | | New Yarn | | |
|---|---|---|---|---|---|---|
| | Sritex Indonesia | Tah Tong Vietnam | Tainan Vietnam | Sritex Indonesia | Tah Tong Vietnam | Tainan Vietnam |
| RKM | 16.90 | 19.9 | 15.5 | 19.30 | 17.50 | 15.10 |
| TPI | 20.50 | 21.8 | 20.2 | 20.19 | 20.2 | 19.9 |
| Classimat/ 100 km | | | | | | |
| Small Slub | 423 | 385 | 305 | 327 | 299 | 299 |
| Mid Slub | 6 | 60 | 48 | 2 | 34 | 50 |
| Big Slub | 0 | 2 | 2 | 0 | 9 | 1 |
| Short Thick | 429 | 0 | 43 | 329 | 0 | 23 |
| Long Thick | 0 | 0 | 12 | 2 | 0 | 5 |
| Short Thin | 10 | 0 | 0 | 2 | 0 | 0 |
| Long Thin | 2 | 0 | 1 | 0 | 0 | 0 |

One difference between the prior method and the new method relates to the draw frame setting. Conventionally, the draw frame roller settings used to manufacture ring spun polyester cotton blends is 45×48×52 mm. According to the present disclosure, draw frame roller settings of 40.5×40.5×42 mm are used. These settings chosen in part due to the usage of 32 mm (shorter length) recycled polyester fiber as compared to the 38 mm polyester fibers conventionally used for ring spinning cotton polyester blended yarns. Closer roller settings and uniform blending of fibers facilitates movement of the fiber without floating along with longer fibers and between the drafting rollers.

At Tainan Vietnam, the yarn manufacturing trials were conducted with the draw frame setting (Blending, Breaker and Finisher) at 40.5×40.5×42 mm. These settings were adjusted based on the draw frame setting possible given the machinery at that facility.

At Tah Tong Vietnam, the yarn manufacturing trials were conducted with the draw frame setting (Blending and Breaker) at 40×40×42 mm and the Finisher at 38×42 mm. These settings were adjusted based on the draw frame setting possible given the machinery at that facility.

At Indonesia, the yarn manufacturing trials were conducted with the draw frame setting (Blending and Breaker) at 42×44 mm and the Finisher at 40×42 mm. The blending, breaker and finisher configuration in at each of the facilities were different in part do to the difference in the equipment at these facilities.

As discussed above, another difference between the prior method and the new method is in the length of the recycled polyester fibers used to construct the yarn. In the method according to the present disclosure, 32 mm recycled polyester fibers were used in place of the traditionally used 38 mm recycled polyester fibers. The conventional wisdom in textile manufacturing is to use 38 mm polyester fibers for ring spinning manufacturing of cotton polyester blended yarn. Polyester fibers of 32 mm are conventionally used in an open spinning manufacturing process. For years, experts in the industry have accepted this to be the best way to manufacture yarn with few defects.

According to the depicted embodiment, the mean length of cotton fiber used for blending was 28 mm. The upper quartile length measured for cotton was approximately 29 mm. The upper quartile length of cotton post combing varied between 29.5 to 30.5 mm. The testing at the yarn manufacturing facilities demonstrated that blending of 32 mm fiber with above length cotton fiber results in a more uniform blend due to less variation in the length of both fibers. Fiber movement during the draw frame process at the blending stage is more uniform and both of the fibers move uniformly during drafting.

Another difference between the prior method and the new method relates to the denier of the fibers. Fibers of 1.4 denier are conventionally used in the manufacturing of ring spun polyester cotton blends. In the present disclosure, polyester fibers of 1.2 denier were used. The denier of the polyester fibers is discussed in further detail below.

Yarn manufactured from this new ring spinning process has much fewer undesirable visible white undyed specs as compared to the prior art ring spun yarn of the same blend. The ring spinning yarn manufacturing process generally results in yarn that is softer, finer and more twisted than yarn manufactured in an open spinning process. In the depicted embodiment, the twist in the ring spun yarn can be quantified by an equation for twist per inch. The equation for twist per inch is known in the art. TPI=TM×square root of the count. In the depicted embodiment, the TM (Twist Multiplier) for the yarn of the present disclosure is between 3.7-3.9. The twist multiplier corresponds to yarn manufactured from a ring spinning process. Yarn manufactured from an open end spinning process would have a different twist multiplier. For a given count, the twist per inch of ring spun yarn and open spun yarn is different.

A method of ring spinning yarn is provided herein. In one embodiment, the method includes the steps of: providing cotton bales; opening the cotton bales and mixing cotton fibers from at least two bales; carding the cotton fibers to form cotton slivers; drawing the cotton slivers to straighten the cotton fibers in the cotton slivers; and combing the cotton slivers and removing the shortest cotton fibers from the cotton slivers, wherein after the combing step at least ninety percent of the cotton fibers forming the cotton slivers has a length of between 12 millimeters and 44 millimeters. In the depicted embodiment, the combing step results in 29 millimeters to 30 millimeters average cotton fiber length in the cotton sliver.

The method further includes the steps of providing polyester bales, the polyester bales include polyester fibers, wherein at least ninety percent of the polyester fibers are between 30 millimeters and 33 millimeters long and have a linear density of between 1.1-1.3 denier. In the depicted embodiment, the denier selection of the polyester fibers results in the polyester fibers being driven more into the core of the yarn during manufacturing. This cross sectional arrangement of the fibers results in uniform dyeing of the fabric that is woven from the yarn.

According to the method of the present disclosure, additional steps of the method can include: carding the polyester to form polyester slivers; drawing the polyester slivers to straighten the polyester fibers in the polyester sliver; and drawing the cotton slivers and polyester slivers to form blended cotton polyester slivers.

The method of the present disclosure can include setting the distance between draw frame rollers (a first roller, a second roller adjacent to the first roller, and a third roller adjacent to the second roller). In the embodiment of the method, the distance D1 between a central axis of the first roller and a central axis of the second roller is between 40 millimeters and 44 millimeters, the distance D2 between a central axis of the second roller and a central axis of the third roller is between 38 millimeters and 42 millimeters. In some embodiments, the draw frame has a fourth roller adjacent to the third roller and the distance D3 between a central axis of the third roller and a central axis of the fourth roller is between 38 millimeters and 42 millimeters.

The method of the present disclosure can also include the step of roving the cotton polyester slivers to stretch the cotton polyester sliver into a cotton polyester roving and spinning and stretching the roving to form yarn. In the depicted embodiment, the yarn has at least 60 percent cotton by weight. In the depicted embodiment, the yarn formed by the method comprises at least 40 percent by weight polyester fibers. For example, the yarn can be 60 percent cotton and 40 percent polyester.

The method of the present disclosure can also include the steps of weaving or knitting the yarn into cloth and subsequently dyeing the yarn. In the depicted embodiment, the cotton and polyester in the yarn can be dyed differently.

According to some embodiments of the yarn manufacturing method, a ring spinning method includes the step of providing polyester bales, wherein the polyester bales include polyester fibers, wherein at least ninety percent of the polyester fibers are between 30 millimeters and 33 millimeters long and have a linear density of between 1.1-1.3 denier. The method includes the step of drawing cotton slivers and polyester slivers to form blended cotton polyester slivers, wherein the draw frame includes a first roller, a second roller adjacent to the first roller, and a third roller adjacent to the second roller, wherein a distance D1 between a central axis of the first roller and a central axis of the second roller is between 40 millimeters and 44 millimeters, wherein a distance D2 between a central axis of the second roller and a central axis of the third roller is between 38 millimeters and 42 millimeters.

The present disclosure also provides a new yarn. The yarn of the present disclosure is manufactured from a ring spinning process. According to the depicted embodiment, the yarn includes a blend of fibers, wherein the blend includes: cotton fibers, wherein at least ninety percent of the cotton fibers have a length between 12 millimeters and 44 millimeters; and polyester fibers having a length between 30 millimeters and 34 millimeters, and a linear density of 1.1-1.3 denier. According to the depicted embodiment, the blend fibers are twisted together to form the yarn wherein the twist per inch is indicative of yarn manufactured from a ring spinning process. For example, the twist per inch is characterized by a twist multiplier of between 3.7-3.9 for yarns used for knitting and 3.9 to 4.4 weaving yarns.

In one embodiment, the blend includes at least 55 percent by weight cotton and at least 25 percent by weight polyester. In another embodiment, the blend includes at least 55 percent by weight cotton and at least 35 percent by weight polyester.

In some embodiments, the polyester is a recycled polyester. The yarn of the present disclosure is woven or knit into a fabric. In some embodiments, the cotton in the fabric is dyed. The uniformity overall quality of the yarn can be seen by a person's eye when the fabric is dyed. The yarn of the present disclosure is sufficiently free of defects to allow for its use in colored garments.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A ring spun cotton polyester yarn comprising:

a blend of fibers, wherein the blend includes:

cotton fibers from at least two bales; and polyester fibers where at least ninety percent of the polyester fibers have a length between 30 millimeters and 33 millimeters, and a linear density of 1.1-1.3 denier, wherein the blended fibers are twisted together to form the yarn wherein the twist per inch is indicative of yarn manufactured from a ring spinning process, and wherein the yarn is capable of being woven into cloth that is free of undyed specs.

2. The yarn of claim 1, wherein the twist per inch is characterized by a twist multiplier of between 3.7-3.9 for knitting yarns and 3.9 to 4.4 for weaving yarns.

3. The yarn of claim 1, wherein the blend includes at least 55 percent by weight cotton and at least 25 percent by weight polyester.

4. The yarn of claim 1, wherein the blend includes at least 55 percent by weight cotton and at least 35 percent by weight polyester.

5. The yarn of claim 1, wherein at least 90 percent of the cotton fibers have a length between 12 millimeters and 44 millimeters.

6. The yarn of claim 1, wherein the polyester is a recycled polyester.

7. A woven or knit fabric comprising the yarn of claim 1, wherein the cotton in the fabric is dyed.

* * * * *